United States Patent [19]

Biresaw et al.

[11] Patent Number: 4,781,848

[45] **Date of Patent: * Nov. 1, 1988**

[54] METALWORKING LUBRICANT COMPRISING AN OIL-IN-WATER MICROEMULSION

[75] Inventors: Girma Biresaw, Lower Burrell; Ronald A. Reich, Shaler; John Bohaychick; Ronald P. Festa, both of New Kensington, all of Pa.

[73] Assignee: Aluminum Company of America, Pittsburgh, Pa.

[ * ] Notice: The portion of the term of this patent subsequent to Nov. 2, 2005 has been disclaimed.

[21] Appl. No.: 52,385

[22] Filed: May 21, 1987

[51] Int. Cl.[4] ..... C10M 173/00

[52] U.S. Cl. ..... 252/49.5

[58] Field of Search ..... 252/49.5

[56] References Cited

U.S. PATENT DOCUMENTS

| | | | |
|---|---|---|---|
| 2,606,874 | 8/1952 | Garner et al. | 252/308 |
| 3,296,129 | 1/1967 | Scheidker et al. | 252/49.5 |
| 3,649,538 | 3/1972 | Hotten | 252/49.5 |
| 3,928,215 | 12/1975 | Dreher et al. | 252/33.3 |
| 4,337,161 | 6/1982 | Stayner | 252/49.5 |
| 4,371,447 | 2/1983 | Webb et al. | 252/49.5 |
| 4,654,155 | 3/1987 | Kipp et al. | 252/49.5 |

OTHER PUBLICATIONS

"PTO Practice: 'Same Invention' Double Patenting", 69 JPOS 219–223, Examiner-in-Chief Alton D. Rollins.

Kirk-Othmer, Encyclopedia of Chemical Technology, 3rd edition, vol. 8, pp. 900–921.

*Primary Examiner*—William R. Dixon, Jr.

*Assistant Examiner*—Jerry D. Johnson

*Attorney, Agent, or Firm*—Glenn E. Klepac

[57] ABSTRACT

A metalworking lubricant comprising an oil-in-water microemulsion and containing about 1–30 wt % natural or synthetic oil; about 0.5–30 wt % of a water-soluble surfactant, preferably a nonionic surfactant; about 1–20 wt % of an organic consurfactant, preferably 1,2-octanediol; and about 45–97.5 wt % water containing less than about 1 wt % dissolved inorganic salts. The lubricant is suitable for various metalworking methods, including hot rolling and cold rolling of aluminum and aluminum alloys.

20 Claims, 2 Drawing Sheets

METALWORKING LUBRICANT COMPRISING AN OIL-IN-WATER MICROEMULSION

This application is related to co-pending U.S. application Ser. No. 52,384 filed May 21, 1987 for "Lyotropic Liquid Metalworking Lubricant Composition".

FIELD OF THE INVENTION

The present invention relates to a lubricant suitable for use in various metalworking operations. More specifically, the invention relates to a lubricant comprising an oil-in-water microemulsion and to a method for utilizing the lubricant.

BACKGROUND OF THE INVENTION

In the rolling of metals such as aluminum and aluminum alloys, it is customary to flood the rolls and the workpiece with a coolant in order to carry away heat generated by the operation. It is also customary to use as a coolant an emulsion comprising water, mineral oil, and various additives having load bearing and friction-modifying properties to reduce friction between the rolls and workpiece. In order to perform satisfactorily in industry, the lubricant fluid must meet several important requirements.

Among the requirements for a satisfactory metalworking lubricant are stability under operating conditions and corrosion-inhibiting properties. In addition, the lubricant should not cause metal deposits on the rolls and workpiece during the rolling operation. Other important requirements include avoidance of excessive foam formation and thermodynamic characteristics to ensure wetting both the roll and workpiece.

Lubricant emulsions containing water and mineral oil are known in the prior art. While such emulsions may perform satisfactorily in achieving reduction of metal thickness, they are difficult to recycle for reuse. Removal of contaminants from used emulsion fluids requires separation of the oily and aqueous components. Such separation is expensive because it involves addition of chemicals to break the emulsion followed by storage of components in large settling tanks.

Garner et al U.S. Pat. No. 2,606,874 discloses a water-in-oil emulsion readily dispersible in water and consisting essentially of mineral oil, water, a water-soluble anionic surfactant and a 1,2-alkanediol "coupling agent" which is preferably 1,2-octanediol. An electrolyte (6 wt % sodium sulfate) is dissolved in the water in all four specific examples provided. The proportions of ingredients utilized by Garner et al are inconsistent with oil-in-water microemulsions.

Dreher et al U.S. Pat. No. 3,928,215 discloses cutting oil compositions that are said to be like liquid crystals. The compositions comprise a liquid hydrocarbon, water, an anionic surfactant and a cosurfactant which may be any of several different types of organic compounds. The cosurfactant is preferably an aliphatic alcohol and cyclohexanol is used in some examples. Dreher et al do not suggest using 1,2-alkanediols as cosurfactants.

It is a principal object of the present invention to provide a metalworking lubricant comprising an oil-in-water microemulsion that is thermodynamically stable [illegible] ing conditions and readily separable into [illegible] ous components for ease in decontamina- [illegible] cling.

It is a related object of the present invention to provide a lubricant having satisfactory metalworking performance characteristics.

Another object of the invention is to provide an environmentally acceptable lubricant. A preferred composition containing 1,2-alkanediol is much less toxic than prior art microemulsions containing short chain alcohols, which are extremely irritating.

Additional objectives and advantages of the invention will become apparent to persons skilled in the art upon reading the following detailed description of our invention.

SUMMARY OF THE INVENTION

The lubricant of the invention is suitable for use in metalworking and metal removal operations. Metalworking involves operations such as stamping, drawing, and hot and cold rolling. Metal removal involves operations such as grinding, tapping, broaching, and drilling. The lubricant is especially suitable for hot and cold rolling of aluminum and aluminum alloy material into sheet and foil form.

The term "hot rolling" refers to rolling that takes place at a metal entry temperature of approximately 450°-1100° F. (232°-593° C.) for aluminum alloys. Metal entry temperature is usually about 600°-1000° F. (316°-538° C.). Hot rolling of ferrous alloys takes place at metal entry temperatures up to about 2200° F. (1204° C.). Hot rolling is typically employed to reduce slabs of aluminum alloy material that are several inches thick into sheets having a thickness of about ⅛ inch (0.32 cm).

As used herein, the term "cold rolling" refers to rolling in which metal entry temperature ranges from ambient temperature to about 450° F. (232° C.) for aluminum alloys. Cold rolling is typically used to reduce sheets of aluminum alloy material about ⅛ inch (0.32 cm) thick into lesser thicknesses.

In accordance with the present invention, there is provided a lubricant comprising an oil-in-water microemulsion. As used herein, the term "oil-in-water microemulsion" refers to a clear, thermodynamically stable solution of oil in water. The oil is solubilized by a surfactant and a cosurfactant. In microemulsions, the average size of the oil droplets is approximately 50-800 angstroms whereas in emulsions, which are thermodynamically unstable, the average size is greater than about 0.1 micron. A microemulsion is sometimes called a "micellar emulsion".

The lubricant of the invention may also be a mixture of an oil-in-water microemulsion and a lyotropic liquid crystal. As used herein, the term "lyotropic liquid crystal" refers to an anisotropic solution. Liquid crystals flow like liquids while at the same time being ordered like crystals. However, unlike solid crystals, liquid crystals have only one- or two-dimensional order.

The lubricant composition comprises about 1-30 wt % of a natural or synthetic oil, about 0.5-30 wt % of a water-soluble surfactant, about 1-20 wt % of an organic cosurfactant comprising a 1,2-alkanediol, and about 45-97.5 wt % water containing less than about 1 wt % dissolved inorganic salts.

The oil may be a natural or synthetic oil. Preferably, the oil is refined mineral oil or synthetic oil having a viscosity of about 2-100 centistokes at 40° C. The oil is more preferably a branched chain synthetic oil. A particularly preferred branched chain synthetic oil is sold by Exxon Chemical Company under the trademark ISOPAR-M. When the lubricant is designed for cold rolling of aluminum and aluminum alloys, viscosity of the oil should be only about 2–5 centistokes at 40° C. For hot rolling, oil having a viscosity of about 20–110 centistokes at 40° C. is preferred.

Water constitutes about 45–97.5 wt % of the composition, preferably about 55–95 wt %, more preferably about 60–90 wt %. The water should contain less than about 1 wt % dissolved inorganic salts, preferably less than about 200 ppm dissolved salts. Distilled or deionized water having electrical conductivity less than about 400 mho-cm is particularly preferred.

The water contains about 0.5–30 wt % of a water-soluble surfactant, preferably about 1–15 wt % and more preferably about 1–6 wt %. The surfactant may be anionic, cationic, amphoteric, or nonionic with nonionic surfactants being preferred. A particularly preferred nonionic surfactant is sold under the trade name "Lauryl Diethanolamide" and comprises a mixture of $C_8$–$C_{18}$ diethanolamides.

Some other suitable nonionic surfactants include other fatty acid diethanolamides, ethoxylated fatty oils such as ethoxylated castor oil, and ethoxylated alkyl and dialkyl phenols wherein the alkyl groups have from 6 to 22 and preferably 8 to 12 carbon atoms. Such surfactants include, for example, polyethoxylated nonylphenols having about 6–13 ethoxyl groups. Some suitable anionic surfactants are sodium dodecylsulfate (sometimes referred to herein as "SDS"), synthetic sodium sulfonates including sodium dodecylbenzene sulfonate and sodium hexadecyl sulfonate, dipotassium isooctadecenyl succinate and sodium dioctyl sulfosuccinate.

A fourth ingredient of the composition is about 1–20 wt % of an organic cosurfactant comprising a $C_4$–$C_{12}$ 1,2-alkanediol. The cosurfactant preferably comprises about 2–12 wt % of the composition. Two preferred cosurfactants are 1,2-octanediol and 1,2-decanediol. Some other suitable 1,2-alkanediols are 1,2-heptanediol; 2,5-dimethyl-1,2-hexanediol; 2-methyl-1,2-octanediol; 2-methyl-1,2-nonanediol; 2-methyl-1,2-decanediol; 2-methyl-1,2-undecanediol and homologues of such compounds. Mixtures of two or more 1,2-alkanediols are also suitable. A particularly preferred composition utilizes 1,2-octanediol.

The preferred lubricant composition containing 1,2-octanediol as a cosurfactant is more acceptable environmentally than prior art microemulsions containing short chain alcohols. Compounds such as isopropanol and isobutanol can be extremely irritating to persons exposed to their vapors.

The composition may optionally contain about 0.4–8 wt % of a $C_8$–$C_{40}$ fatty acid which is either a mono- or dicarboxylic acid. Oleic acid, isostearic acid and lauric acid are suitable monocarboxylic acids and dilinoleic acid is a suitable dicarboxylic acid. Another suitable dicarboxylic acid is called "dimer acid", which refers to a commercially available mixture of dimeric fatty acids usually containing a total of about 32 to 36 carbon atoms. These acids result from dimerization of unsaturated fatty acids containing about 16 to 18 carbon atoms. When a fatty acid is employed, it generally constitutes about 1–2.5 wt % of the composition.

The fatty acid may be used alone or in combination with a water-soluble alkanolamine. Some suitable alkanolamines are monoethanolamine, diethanolamine, triethanolamine, dimethylethanolamine, diethyl-ethanolamine, amino-ethyl-ethanolamine, methyl-diethanolamine, N-acetyl ethanolamine, phenylethanolamine, phenyldiethanolamine, mono-, di-, and triisopropanolamine, and mixtures of any of the foregoing alkanolamines. Some preferred alkanolamines are triethanolamine, diethanolamine, and ethyl-diisopropanolamine. The alkanolamine generally constitutes about 0.4–6 wt % of the composition.

The lubricant may also contain other additives that are useful under certain conditions. Such additives include biocides, oxidation inhibitors, corrosion inhibitors, and antifoam agents.

DETAILED DESCRIPTION OF A PREFERRED EMBODIMENT

Figure 1:
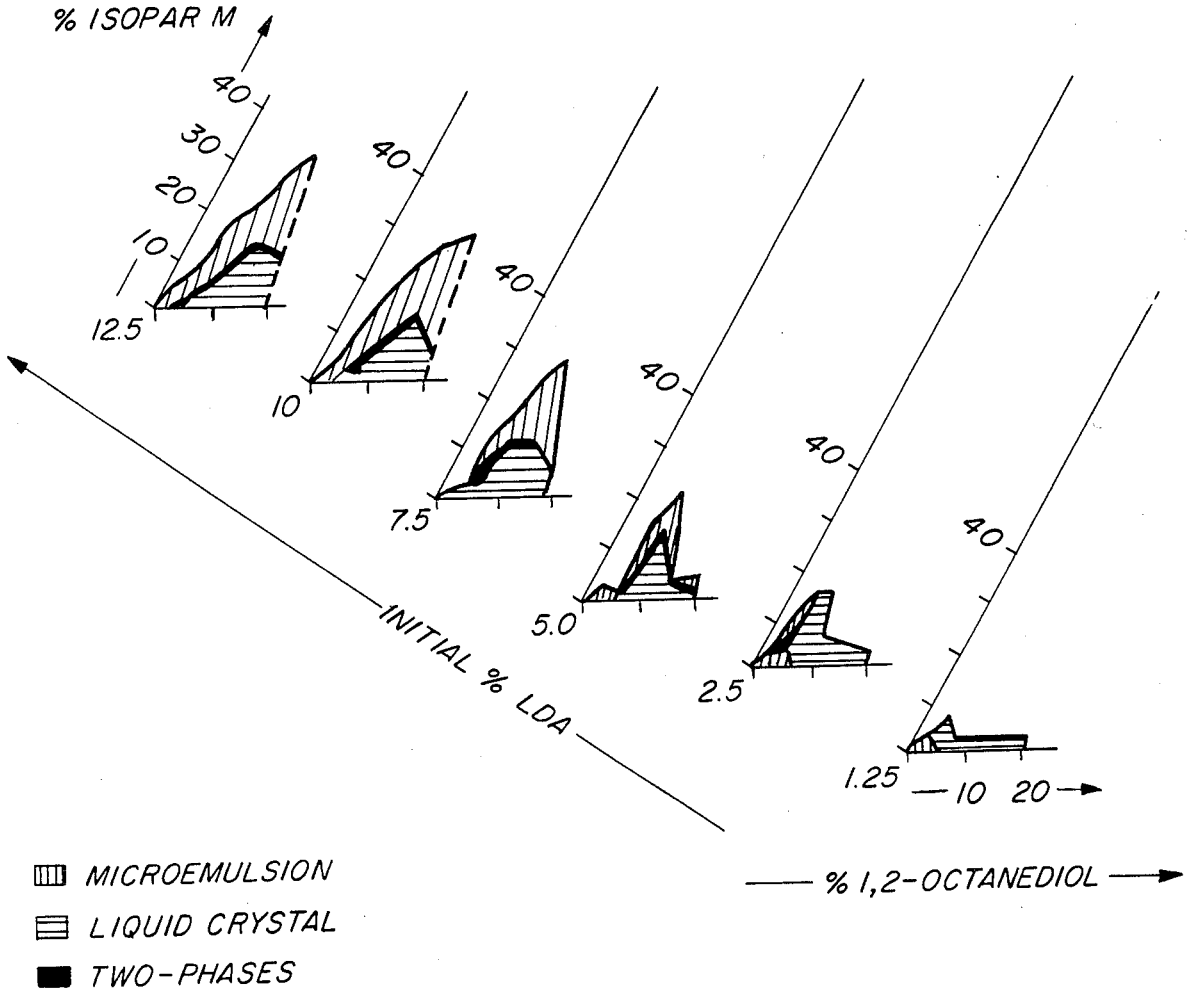
FIG. 1 is a series of partial pseudo-ternary phase diagrams for the system water-nonionic surfactant-octanediol-synthetic oil.
Figure 2:
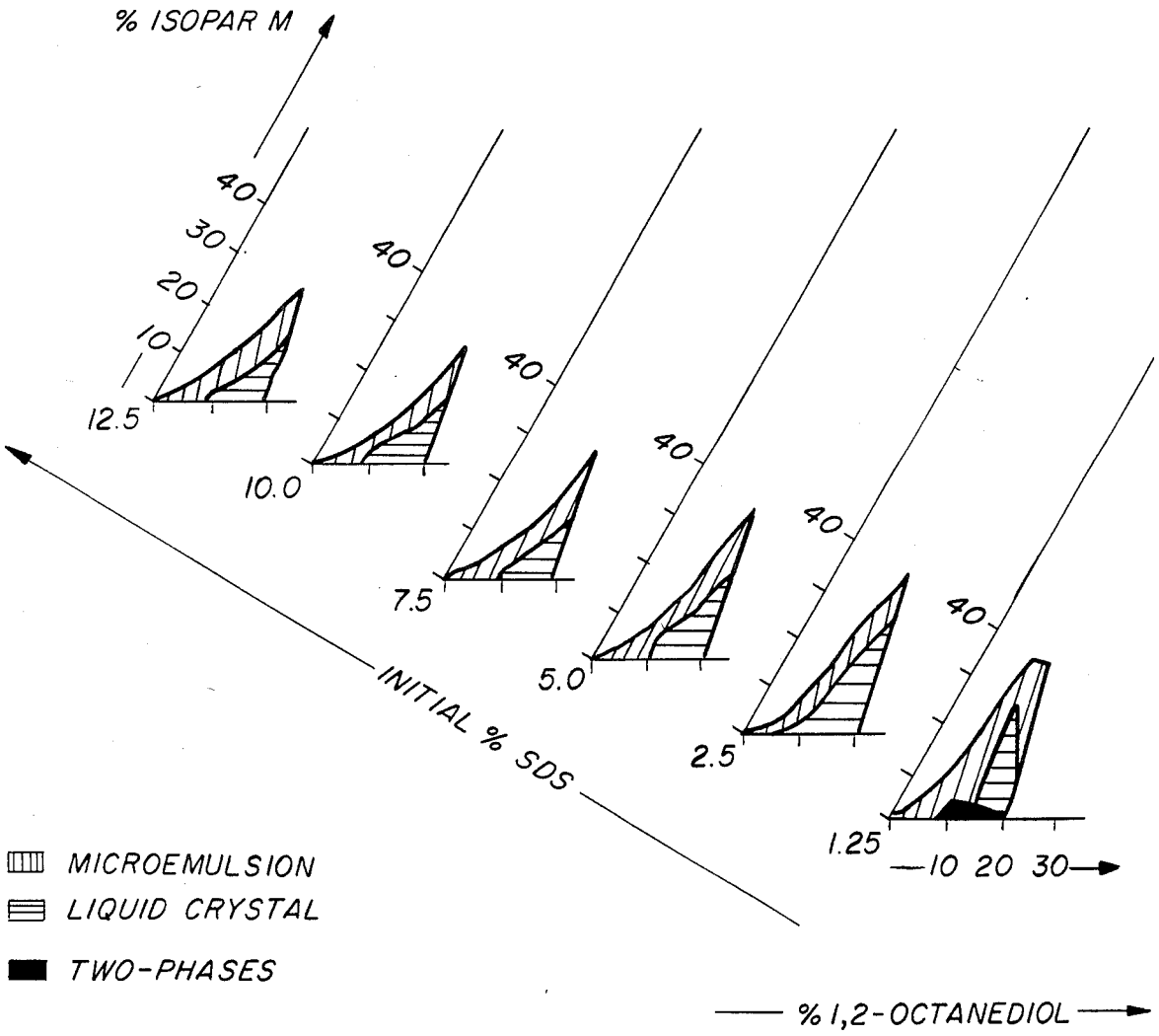
FIG. 2 is a series of pseudo-ternary phase diagrams for the system water-anionic surfactant-octanediol-synthetic oil.

Four-component phase diagrams were obtained in order to determine optimum concentrations of ingredients for the lubricant composition of the invention. FIG. 1 is a set of partial pseudo-ternary phase diagrams for the system water-nonionic surfactant-octanediol-synthetic oil. As used herein, the term "pseudo-ternary phase diagram" refers to a partial phase diagram of a four-component system wherein the ratio of two components remains constant. In FIG. 1, the ratio of nonionic surfactant (LDA) to water was held constant. That ratio is indicated as a weight percentage of LDA ranging from 1.25 to 12.5. In FIG. 2, the ratio of the anionic surfactant (SDS) to water was held constant at various proportions ranging from 1.25 to 12.5 wt %.

As used herein, the term "LDA" refers to a nonionic surfactant sold by Phaltz & Bauer under the trade name "Lauryldiethanolamide, 90%". Actual analysis of LDA by gas chromatography and mass spectroscopy revealed the following ingredients:

| Component Class | Total Peak Area, % |
|---|---|
| $C_8$–$C_{18}$ fatty acid diethanolamides, mostly $C_{12}$ diethanolamide | 51.7 |
| Alkanolamines, mostly diethanolamine | 29.6 |
| Fatty acids, mostly lauric acid | 7.7 |
| Unidentified | 11.0 |
| Total | 100.0 |

Some particularly preferred oil-in-water microemulsion lubricant compositions were made up in accordance with the formulations shown in Table I. Each formulation contained deionized water; synthetic oil (branched chain polyolefin having a viscosity of about 2.17 centistokes at 40° C.); a nonionic surfactant (LDA) and 1,2-octanediol cosurfactant. The particularly preferred synthetic oil is sold by Exxon Chemical Company under the trademark ISOPAR M. The formulations also contained varying amounts of triethanolamine (TEA). Kinematic viscosities at 25° C. and 40° C. are stated in centistokes.

Friction and wear tests were performed between steel rings and 5182 aluminum alloy blocks on an Alpha Model LFW-1 ring-on-block tester at a coolant temperature of 100° F. (38° C.). Maximum load forces were measured in pounds.

TABLE I

| | Formulation Number | | | | | | | | | |
|---|---|---|---|---|---|---|---|---|---|---|
| | 5-2 | 5-3 | 6-3 | 6-4 | 7-4 | 7-5 | 8-5 | 8-6 | 8-7 | 9-7 |
| Oil | 2 | 4 | 4 | 6 | 6 | 8 | 8 | 10 | 12 | 12 |
| Water | 88 | 86 | 86 | 84 | 84 | 82 | 82 | 80 | 78 | 78 |
| Octanediol | 3.00 | 3.00 | 3.75 | 3.75 | 4.50 | 4.50 | 5.25 | 5.25 | 5.25 | 6.00 |
| LDA | 2.50 | 2.50 | 2.50 | 2.50 | 2.50 | 2.50 | 2.50 | 2.50 | 2.50 | 2.50 |
| Triethanolamine | 4.50 | 4.50 | 3.75 | 3.75 | 3.00 | 3.00 | 2.75 | 2.25 | 2.25 | 2.25 |
| Viscosity, 25° C. | 1.88 | 2.39 | 6.68 | 4.40 | 19.04 | 16.40 | 18.67 | 22.54 | 24.78 | 14.22 |
| Viscosity, 40° C. | 1.41 | 1.81 | 5.75 | 4.16 | 11.45 | 13.44 | 9.68 | 10.43 | 11.27 | * |
| Maximum Load/COF Giving a Scar Rating of: | | | | | | | | | | |
| Smooth | 18/0.11 | 18/0.11 | 18/0.11 | 36/0.11 | 18/0.11 | 36/0.11 | 36/0.11 | 36/0.11 | 36/0.11 | 18/0.14 |
| Intermediate | 36/0.15 | 36/0.11 | 36/0.13 | 72/0.11 | 72/0.13 | — | — | 72/0.14 | 72/0.16 | — |
| Rough | 72/0.17 | 72/0.15 | 72/0.19 | 141/0.14 | 105/0.17 | 105/0.17 | 105/0.17 | 105/0.13 | 105/0.17 | 105/0.18 |

*Composition was two phases at this temperature.

The viscosity data in Table I show that formulations containing higher oil concentrations generally have lower viscosities. Increasing the concentration of triethanolamine generally reduced viscosity. Viscosities were consistently higher at 25° C. than at 40° C.

The friction and wear data in Table I indicate that formulations containing higher oil concentrations generally show improved load-bearing capacity and slightly better friction properties than formulations with lower oil concentrations.

Some particularly preferred microemulsion lubricant compositions were subjected to various metal rolling tests. Cold rolling tests were conducted on a small single-stand laboratory rolling mill having a 4 inch diameter work roll and 10 microinch roll grind. Initial coolant temperature was 100° F. and initial roll temperature was 150° F. The specimens tested were a soft (3004-0) aluminum alloy having entry gauge of 0.16 inch and a hard (5182-0) aluminum alloy having entry gauge of 0.0135 inch.

TABLE II

| | Composition, wt % | | | | Rolling Data | | |
|---|---|---|---|---|---|---|---|
| Formulation | Surfactant | Octanediol | Synthetic Oil | TEA | Aluminum Alloy | Maximum Reduction, % | Maximum Load Force, Klb. |
| 1 | SDS, 1.25 (SDS used as supplied) | 7.5 | 6.8 | — | 3004 | 50 | 46.0 |
| | | | | | 5182 | 41 | 43.2 |
| | | | | | | 41 | 40.2 |
| 2 | SDS, 1.25 (SDS, recrystallized from ethanol) | 7.5 | 6.8 | — | 3004 | 50 | 44.4 |
| | | | | | 5182 | 41 | 25.8 |
| 3 | LDA, 2.5 | 5.0 | 10 | — | 3004 | 59 | 46.8 |
| 4 | LDA, 2.5 | 5.0 | 10 | 2.2 | 3004 | 53 | 57.3 |

TABLE III

| | | Rolling Data | | |
|---|---|---|---|---|
| Formulation | Boundary Additive, wt % | Aluminum Alloy | Maximum Reduction, % | Maximum Load Force, Klb. |
| 5 | Oleic acid, 2.0 | 3004 | 75 | 24.0 |
| | | 5182 | 39 | 30.0 |
| | | | 44 | 41.0 |
| 6 | Dimerized Linoleic Acid, 2.0 | 3004 | 81 | 45.6 |
| | | | 75 | 39.6 |
| | | 5182 | 48 | 45.9 |
| 7 | Prior Art Emulsion | 3004 | 78 | 30.0 |
| | | | 75 | 40.0 |
| | | 5182 | 70 | 39.9 |

The formulations used in the tests summarized in Table II each contained deionized water; synthetic oil (branched chain polyolefin having a viscosity of about 2.17 centistokes at 40° C.); an anionic surfactant (SDS or LDA) and 1,2-octanediol cosurfactant. Formulation No. 4 also contained about 2.2 wt % triethanolamine (TEA).

An additional set of tests summarized in Table III was conducted with microemulsion lubricants containing oleic acid (Formulation No. 5) and dimerized linoleic acid (Formulation No. 6) as boundary additives. The microemulsions were each based upon the following formula: branched chain polyolefin synthetic oil 10 wt %; nonionic surfactant (LDA) 2.5 wt %; octanediol 5.0 wt %; fatty acid boundary additive 2.0 wt %; triethanolamine 2.2 wt %; and remainder deionized water.

The formulations in Table II did not contain film strength additives and, as a result, maximum reductions were lower and maximum loads were higher than for Formulation Nos. 5 and 6. As expected, the soft (3004) alloys were easier to reduce than hard (5182) alloys. Also, the results on 3004 alloy were similar for the anionic surfactant (SDS) and the nonionic surfactant (LDA). Addition of triethanolamine (TEA) to the nonionic surfactant did not produce significant changes for 3004 alloy. Comparisons of Formulation Nos. 1 and 2 indicates that purity of the SDS is not a significant factor. In general, the microemulsions tested were not corrosive and produced less smudge on the rolled metal than typical emulsions.

The test results in Formulation Nos. 5 and 6 in Table III show that boundary additives increased maximum reductions and lowered maximum load forces on 3004 alloy specimens. The effect was minor on 5182 alloy specimens. The microemulsions (Formulation Nos. 5 and 6) produced comparable maximum reductions and load forces on 3004 alloy compared with an emulsion (Formulation No. 7). However, the emulsion performed better than the microemulsions with respect to both reduction and load force on 5182 alloy.

While the invention has been described in terms of a few preferred embodiments, the following claims are intended to encompass all embodiments falling within the spirit of the invention.

What is claimed is:

1. A lubricant composition suitable for use in metalworking and having the following ingredients:

(a) about 1–30 wt % of a natural or synthetic oil, (b) about 0.5–30 wt % of a water-soluble surfactant, (c) about 1–20 wt % of an organic cosurfactant comprising a $C_4$–$C_{12}$ 1,2-alkanediol, and (d) about 45–97.5 wt % water containing less than about 1 wt % dissolved inorganic salts; and wherein the relative proportions of (a), (b), (c), and (d) are such that the composition comprises an oil-in-water microemulsion.

2. The composition of claim 1 wherein the electrical conductivity of said water is less than about 400 mho-cm.

3. The composition of claim 1 wherein said oil comprises a polyolefin synthetic oil.

4. The composition of claim 3 wherein said synthetic oil comprises predominantly a branched chain polyolefin.

5. The composition of claim 4 wherein the viscosity of said oil is about 2–100 centistokes at 40° C.

6. The composition of claim 1 wherein said surfactant comprises a nonionic surfactant.

7. The composition of claim 6 wherein said nonionic surfactant comprises a mixture of $C_8$–$C_{18}$ diethanolamides.

8. The composition of claim 1 wherein said cosurfactant comprises 1,2-octanediol.

9. The composition of claim 1 further comprising:

(e) about 0.4–8 wt % of a $C_8$–$C_{40}$ mono- or dicarboxylic acid.

10. The composition of claim 9 further comprising:

(f) about 0.4–6 wt % of a water-soluble alkanolamine.

11. The composition of claim 1 comprising:

(a) about 5–25 wt % synthetic oil having a viscosity of about 2–100 centistokes at 40° C., (b) about 1–20 wt % of a water-soluble nonionic surfactant, (c) about 3–15 wt % 1,2-octanediol, and (d) about 60–90 wt % water.

12. The composition of claim 11 wherein said nonionic surfactant comprises a mixture of $C_8$–$C_{18}$ diethanolamides and said composition is defined by at least one of the microemulsion regions shown in FIG. 1.

13. The composition of claim 1 wherein said surfactant is an anionic surfactant.

14. The composition of claim 13 wherein said anionic surfactant comprises sodium dodecylsulfate and said composition is defined by at least one of the microemulsion regions shown in FIG. 2.

15. A method for metalworking comprising the steps of:

(a) applying to a metal object a lubricant composition containing about 1–30 wt % of a natural or synthetic oil, about 0.5–25 wt % of a water-soluble surfactant, about 1–20 wt % of an organic cosurfactant comprising a $C_4$–$C_{12}$ 1,2-alkanediol and about 45–97.5 wt % water containing less than about 1 wt % dissolved inorganic salts, the relative proportions of the oil, surfactant, cosurfactant, and water being such that the composition comprises an oil-in-water microemulsion, and (b) performing a metalworking operation on the object.

16. The method of claim 15 wherein said metal object comprises aluminum or an aluminum alloy.

17. The method of claim 15 wherein said metalworking operation comprises hot rolling or cold rolling the metal object.

18. The method of claim 15 wherein said metal object comprises aluminum or an aluminum alloy and said metalworking operation comprises cold rolling the object at about ambient temperature to 232° C.

19. The method of claim 15 wherein said composition further comprises about 0.4–8 wt % of a $C_8$–$C_{40}$ mono- or dicarboxylic acid.

20. The method of claim 15 wherein said cosurfactant comprises 1,2-octanediol.

* * * * *

UNITED STATES PATENT AND TRADEMARK OFFICE

CERTIFICATE OF CORRECTION

PATENT NO. : 4,781,848

DATED : November 1, 1988

INVENTOR(S) : Girma Biresaw, Ronald A. Reich, John Bohaychick, Ronald P. Festa

It is certified that error appears in the above-identified patent and that said Letters Patent is hereby corrected as shown below:

| | |
|---|---|
| Col. 1, line 7 | After "Liquid" insert --Crystal--. |
| Col. 1, line 66 | Should read --under operating conditions and readily separable into-- |
| Col. 1, line 67 | Should read --oily and aqueous components for ease in decontamina- -- |
| Col. 1, line 68 | Should read --tion and recycling.-- |

Signed and Sealed this

Seventh Day of March, 1989

*Attest:*

DONALD J. QUIGG

*Attesting Officer*

*Commissioner of Patents and Trademarks*